US010087792B2

(12) United States Patent
Stretch

(10) Patent No.: US 10,087,792 B2
(45) Date of Patent: Oct. 2, 2018

(54) TWO PATH TWO STEP ACTUATOR

(71) Applicant: Eaton Corporation, Cleveland, OH (US)

(72) Inventor: Dale Arden Stretch, Novi, MI (US)

(73) Assignee: Eaton Intelligent Power Limited, Dublin (IE)

( * ) Notice: Subject to any disclaimer, the term of this patent is extended or adjusted under 35 U.S.C. 154(b) by 87 days.

(21) Appl. No.: 15/031,222

(22) PCT Filed: Oct. 16, 2014

(86) PCT No.: PCT/US2014/060830

§ 371 (c)(1),
(2) Date: Apr. 21, 2016

(87) PCT Pub. No.: WO2015/057925

PCT Pub. Date: Apr. 23, 2015

(65) Prior Publication Data

US 2016/0245133 A1 Aug. 25, 2016

Related U.S. Application Data

(60) Provisional application No. 61/892,371, filed on Oct. 17, 2013, provisional application No. 61/935,659, filed on Feb. 4, 2014.

(51) Int. Cl.
*F01L 9/04* (2006.01)
*F01L 9/02* (2006.01)
(Continued)

(52) U.S. Cl.
CPC ..... *F01L 9/02* (2013.01); *F01L 3/20* (2013.01); *F01L 9/04* (2013.01); *F01L 13/06* (2013.01);
(Continued)

(58) Field of Classification Search
CPC ..... F01L 9/02; F01L 9/04; F01L 3/20; F01L 2009/0421; F01L 13/06; F01L 2810/04
See application file for complete search history.

(56) References Cited

U.S. PATENT DOCUMENTS 5,682,846 A 11/1997 Scharnweber
6,536,388 B2 3/2003 Lou
(Continued)

FOREIGN PATENT DOCUMENTS

CN 101375024 A 2/2009
CN 204357518 U 5/2015
WO 2015057925 A1 4/2015

OTHER PUBLICATIONS

International Search Report and Written Opinion of the International Searching Authority for PCT/US2014/060830 dated Jan. 26, 2015, pp. 1-18.

*Primary Examiner* — Zelalem Eshete
(74) *Attorney, Agent, or Firm* — Mei & Mark, LLP

(57) ABSTRACT

An actuator comprises a hollow first piston (11) comprising a first extant with a first outer diameter (D1) and a second extant comprising a second outer diameter (D2), where D1>D2. A second piston (12) is slidable within the first piston. An actuator housing (14) comprising a recess (22), a first tubular port (23) in communication with the first piston, and a second tubular port (24) in communication with the second piston. The first extant has a length (L1) and wherein the second extant has a length (L2). The first tubular port extends for a length (L4), and the recess extends for a length (L3), where L4≥L2, and where L3>L2>L1. The first piston and the second piston are housed in the recess.

27 Claims, 7 Drawing Sheets

(51) Int. Cl.
*F01L 13/06* (2006.01)
*F01L 3/20* (2006.01)

(52) U.S. Cl.
CPC ... *F01L 2009/0421* (2013.01); *F01L 2810/04* (2013.01)

(56) References Cited

U.S. PATENT DOCUMENTS

| | | | | |
|---|---|---|---|---|
| 7,213,549 | B2 | 5/2007 | Lou | |
| 7,243,624 | B2 | 7/2007 | Kenchington | |
| 7,290,509 | B2 | 11/2007 | Lou | |
| 7,370,615 | B2 | 5/2008 | Lou | |
| 8,056,515 | B2 | 11/2011 | Hedman | |
| 2002/0073946 | A1 | 6/2002 | Lou | |
| 2004/0050349 | A1 | 3/2004 | Leman et al. | |
| 2004/0060529 | A1* | 4/2004 | Nan | F01L 9/02 123/90.12 |
| 2006/0011060 | A1 | 1/2006 | Kenchington | |
| 2007/0022986 | A1 | 2/2007 | Lou | |
| 2007/0022987 | A1 | 2/2007 | Lou | |
| 2007/0022988 | A1 | 2/2007 | Lou | |
| 2010/0199933 | A1* | 8/2010 | Alajoki | F01L 9/02 123/90.12 |

* cited by examiner

TWO PATH TWO STEP ACTUATOR

This is a § 371 Application of PCT/US2014/060830 filed Oct. 16, 2014 and claims the benefit of U.S. provisional application No. 61/892,371 filed Oct. 17, 2013 and U.S. provisional application No. 61/935,659 filed Feb. 4, 2014, all of which are incorporated herein by reference.

FIELD

This application relates to engine valve actuation. More specifically, the application provides a two step actuator with two fluid pathways.

BACKGROUND

Electro-hydraulic valve actuators have the ability to actuate an engine valve by cooperating with control electronics and hydraulic fluid. The engine valve can be controlled to allow the engine to receive a mixture of air and fuel for combustion and to release exhaust.

SUMMARY

The devices disclosed herein improve the art by way of an actuator comprising a hollow first piston comprising a first extant with a first outer diameter D1 and a second extant comprising a second outer diameter D2, where D1>D2. A second piston is slidable within the first piston. An actuator housing comprises a recess, a first tubular port in communication with the first piston, and a second tubular port in communication with the second piston. The first extant has a length L1 and wherein the second extant has a length L2. The first tubular port extends for a length L4, and the recess extends for a length L3, where L4≥L2, and where L3>L2>L1. The first piston and the second piston are housed in the recess.

The actuator may be included in an electro-hydraulically actuated engine valve, comprising a hydraulic connector comprising a first hydraulic fluid port, a second hydraulic fluid port, and a hydraulic fluid outlet. A spool valve assembly can comprise a first spool inlet, a second spool inlet, a spool outlet, a first spool port, a second spool port, an actuatable spool, and actuation devices. A valve stem assembly abuts the actuator housing, and a valve stem is slidably housed in the valve stem assembly. The valve stem abuts the second piston. The valve stem comprises a valve head configured to adjust an opening or closing of a fluid exchange area of an engine block. The first spool inlet aligns with the first hydraulic fluid port, the second spool inlet aligns with the second hydraulic fluid port, and the spool outlet aligns with the hydraulic fluid outlet. The spool comprises grooves, and the spool is slidable in the spool valve assembly to slide the grooves in to and out of alignment with the first spool inlet, the second spool inlet, the spool outlet, the first spool port, and the second spool port.

A method of operating an electro-hydraulic actuator, using the above actuator, comprises the steps of supplying fluid at a first pressure to the first tubular port, and supplying fluid at a second pressure to the second tubular port.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Figure 1A:
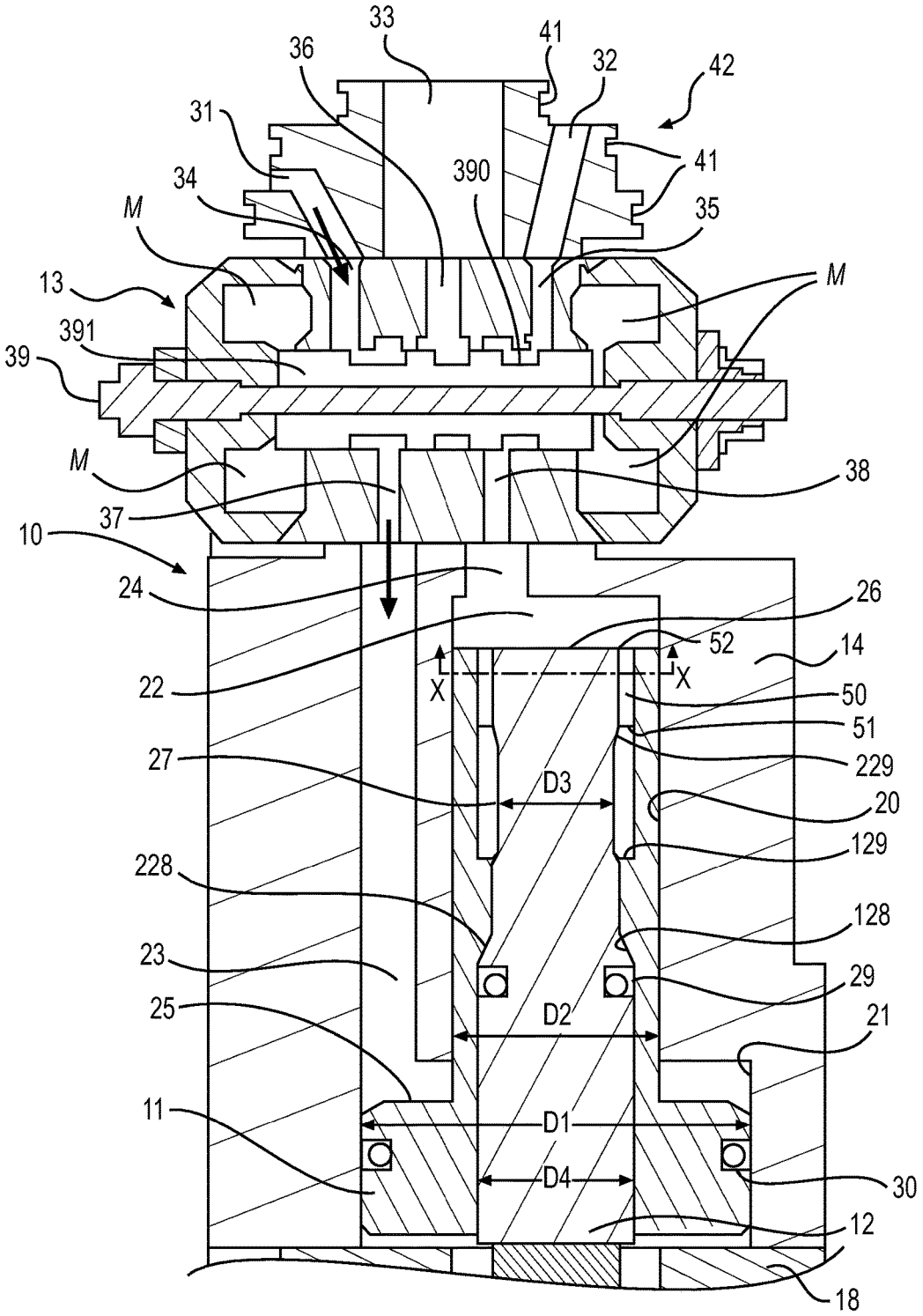
FIG. 1A is a cross-section view of an actuator with hydraulic connection and spool valve assembly and in a position to perform engine braking.

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures. The drawings are not to scale.

An actuator 10 for an engine valve 15 comprises a primary actuator (first piston) 11 and a secondary actuator (second piston) 12. A fluid, such as oil or other hydraulic fluid, is fed to the actuator 10 via a spool valve assembly 13, which can be electromagnetically controlled. An actuator base 14 houses the first and second pistons 11, 12 relative to an engine 17 to enable the pistons to move the valve 15 for exchanging combustion fluids or exhaust in a fluid exchange area 19. Among other reasons, the actuator 10 is tailored and controlled for providing a specific valve seating velocity and extent of valve motion for use in either an intake manifold or exhaust manifold.

One use of the actuator can be for engine braking, where the valve is moved slightly to release fluid pressure from the combustion chamber, which slows the crankshaft rotations per minute (RPM). By slowing the RPM of the crankshaft, driveline parts coupled indirectly thereto can also slow, thus providing a braking effect to the vehicle. The actuator of the disclosure provides a reduction in noise associated with engine braking.

The actuator 10 of FIG. 1A is shown with a spool valve assembly 13 and hydraulic connector 42. Actuator 10 has a hollow first piston 11 that can reciprocate along axis A-A. The inner surface of first piston 11 can include chamfering or other angled first and second edges 128, 129 to provide a stop for bracing motion of concentric and internally located second piston 12. For example, mating chamfering or other angled third edge 228 of second piston 12 abuts first edge 128 in a first position to prevent over-travel of piston 12 in an upward direction. The mating of third edge 128 with first edge 128 also causes the second piston 12 to travel downward with the first piston 11. In a second position, the second edge 129 abuts a ring surface 51 of ring 50 when the second piston 12 travels downward within the first piston 11.

First piston comprises a first extant 111 with a first outer diameter D1 and a second extant 112 comprising a second outer diameter D2, where D1>D2. Because of the diameter differences, first piston 11 has an inverted "T" shape. The first extant 111 has a length L1 and the second extant 112 has a length L2. The overall length of the first piston is L1+L2.

Second piston 12 has a length L7 and is slidable with and within first piston 11. When the first piston 11 moves a distance away from first tubular port 23, the second piston 12 also moves the distance via mating first edge 128 with third edge 228. And, when appropriate fluid pressure is supplied via second tubular port 24, the second piston is slidable within the first piston to reciprocate between a first position mating first edge 128 and third edge 228 and a second position mating second edge 129 and ring surface 51. Ring 50 can be press-fit to piston 12, or ring 50 can be rolled or crimped at location 52, or ring 50 can be pinned to piston 12.

Figure 1B:
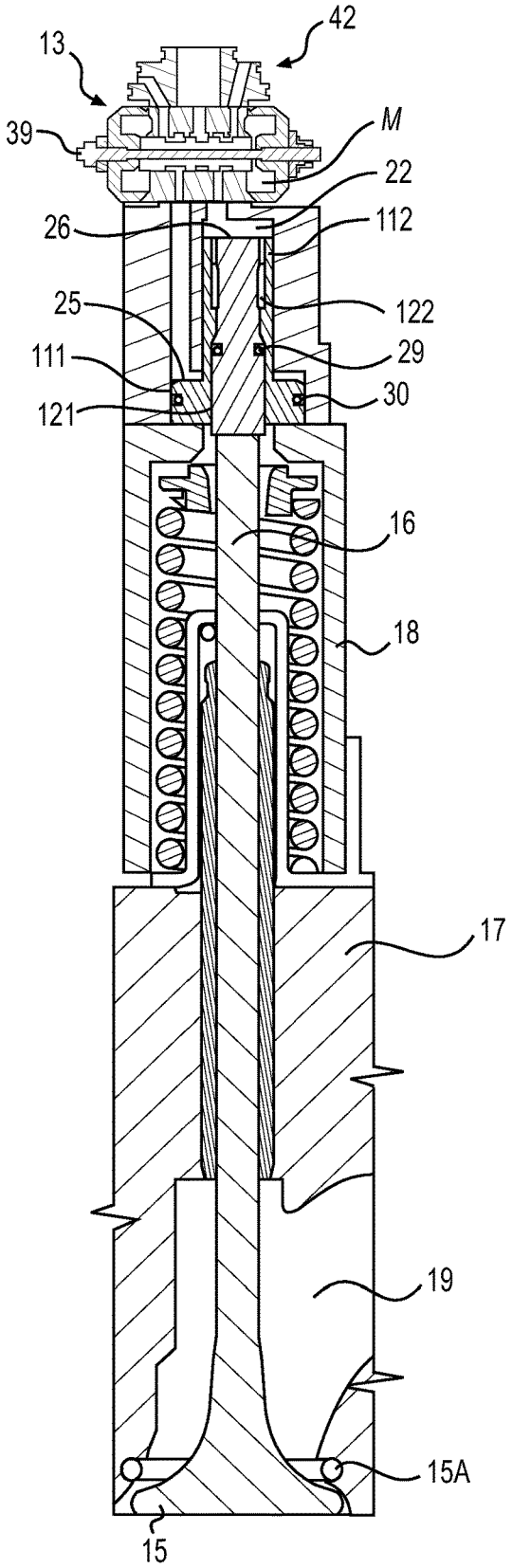
FIG. 1B is cross-section view of an electro-hydraulically actuated engine valve comprising the actuator of FIG. 1A.
Figure 1C:
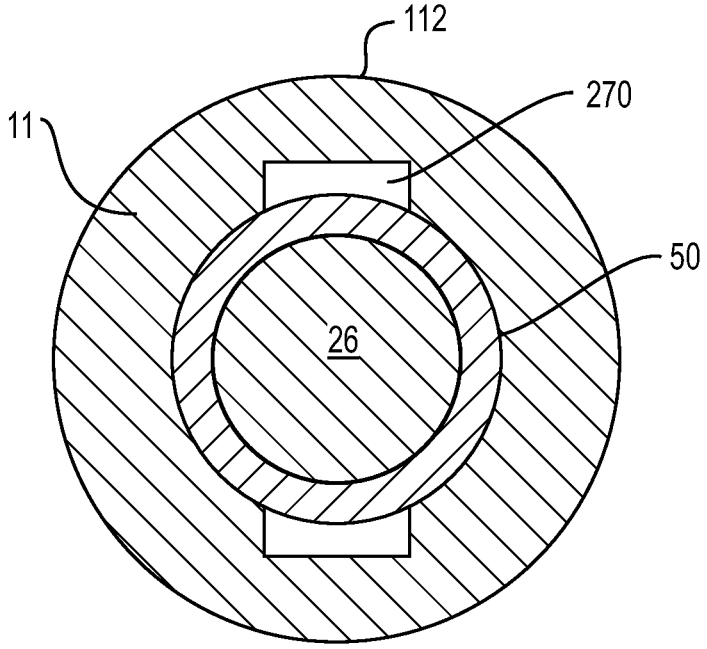
FIG. 1C is a cross-section view along line X-X of FIG. 1A.

The inner surface of first piston 11 can be distanced from second piston 12 to create a fluid recess 27. Fluid access to the fluid recess can be as illustrated in FIG. 1C. The second extant 112 includes, on its inner diameter, a cylindrical hollow portion for receiving the ring 50 and piston 26 therein. A notch 270 on inner sides of the cylindrical hollow portion provides a passageway for fluid to and from fluid recess 27. The notch 270 can extend alongside a diameter change in the second piston to provide the fluid recess 27, or alternatively, additional grooving or diameter changes in the inner surface and/or on second piston 12 can be used to implement fluid recess 27.

The first tubular port 23 can be parallel to the second tubular port 24. An axis A-A of the concentric first and second piston 11 and 12 can be parallel to a central first axis B-B of first tubular port 23 and can be parallel to a central second axis C-C of second tubular port 24. When fluid supply is controlled to the actuator, the first and second pistons can reciprocate in the recess 22 along the axis A-A.

A first cylindrical portion 121 with a diameter D4 can abut the inner surface of first piston 11. A fluid seal 29 comprising a gland and o-ring, can prevent fluid from passing from the fluid recess 27 to the valve stem 16 and to valve stem assembly 18. A second cylindrical portion 122 has a diameter D3, and other diameter changes can be as illustrated. The diameter changes impact the actuation efficiency of the actuator 10. For example, because D3 is less than D1, the actuation efficiency is improved. And, because D4 is less than D1, actuation efficiency is improved. That is, prior art devices provided engine valve actuation using a single piston having the diameter D1. Such a prior art piston required more power to actuate than the illustrated two-step actuator having a larger diameter piston and a smaller diameter piston.

An actuator housing 14 comprises a recess 22 for housing the first and second piston 11, 12. A first tubular port 23 is in fluid communication with an interface 25 of the first piston 11. A second tubular port 24 is in fluid communication with an interface 26 of the second piston 12. The first tubular port extends for a length L4 alongside the second extant 112, where L4≥L2. The first tubular port 23 and the second tubular port 24 are parallel to one another along their respective center axis B-B and C-C. Second tubular port 24 is alongside the first tubular port 23 within the actuator housing 14, but first tubular port 23 is longer than second tubular port 24 by at least the length L2 of second extant 112. The recess 22 is longer than the overall length of first piston 11 and extends for a length L3, where L3>L2>L1 and L3>(L2+L1). The recess 22 is longer than the first piston by at least the length of first travel range T1.

Recess 22 comprises an upper recess 20 with a length L5 and a lower recess 21 with a length L6, wherein the first extant 111 is slidable in the lower recess 21, wherein the second piston 12 is slidable through the lower recess 21, wherein the second extant 112 is slidable in the upper recess 20, and wherein the second piston 12 is slidable in the upper recess 20. To seal the hydraulic fluid in the actuator housing 14, the first extant 111 can include a fluid seal 30 having a gland and o-ring and the cylinder 121 can comprise the fluid seal 29 having a gland and o-ring.

When fluid of sufficient pressure is supplied to the first tubular port 31, the fluid presses against the interface 25 and moves first piston a travel distance in the range T1, and the piston travels towards engine block 17. Because edge 228 of second piston 12 abuts edge 128 of first piston 11, second piston 12 moves with first piston 11 to move valve 15. The range of distance travel of first piston 11 is limited, and can be sufficient to enable engine braking by releasing pressure out of a compression cylinder associated with valve 15. Such a state is shown in FIGS. 1A and 1B.

To effectuate the travel in first travel range T1, the fluid pressure to first tubular port 23 is sufficient to overcome valve head force, or pressure from the combustion chamber of engine 17, and to overcome the spring preload, or spring force in valve stem assembly 18. Fluid pressure to second tubular port 24 can be ambient pressure, or another pressure less than the actuation pressure, to avoid full valve lift during engine braking.

Supplying fluid of sufficient pressure to second tubular port 24 creates pressure against interface 26. This fluid pressure overcomes any valve head force present and overcomes the spring preload. For full valve lift, the pressure to second tubular port 24 can be the same as that supplied to first tubular port 23, or, the pressure to second tubular port 24 can be ambient.

Figure 4A:
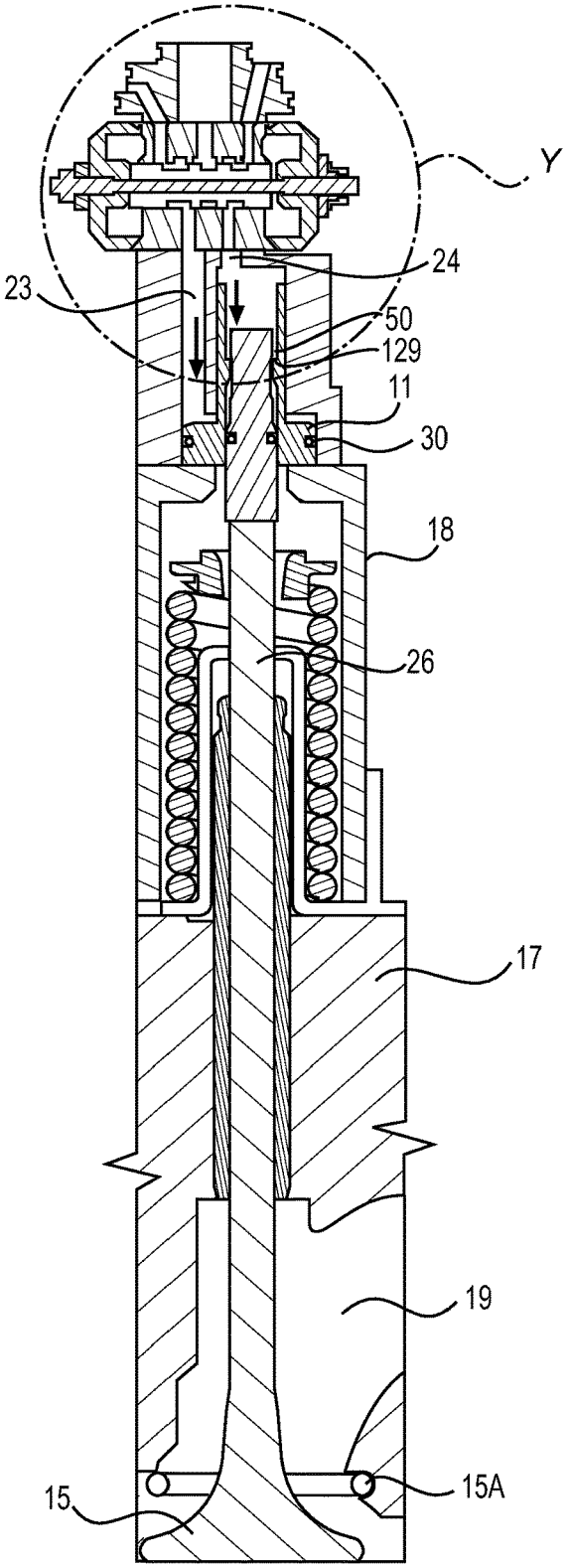
FIG. 4A is a cross-section view illustrating a fully actuated electro-hydraulically actuated engine valve.
Figure 4B:
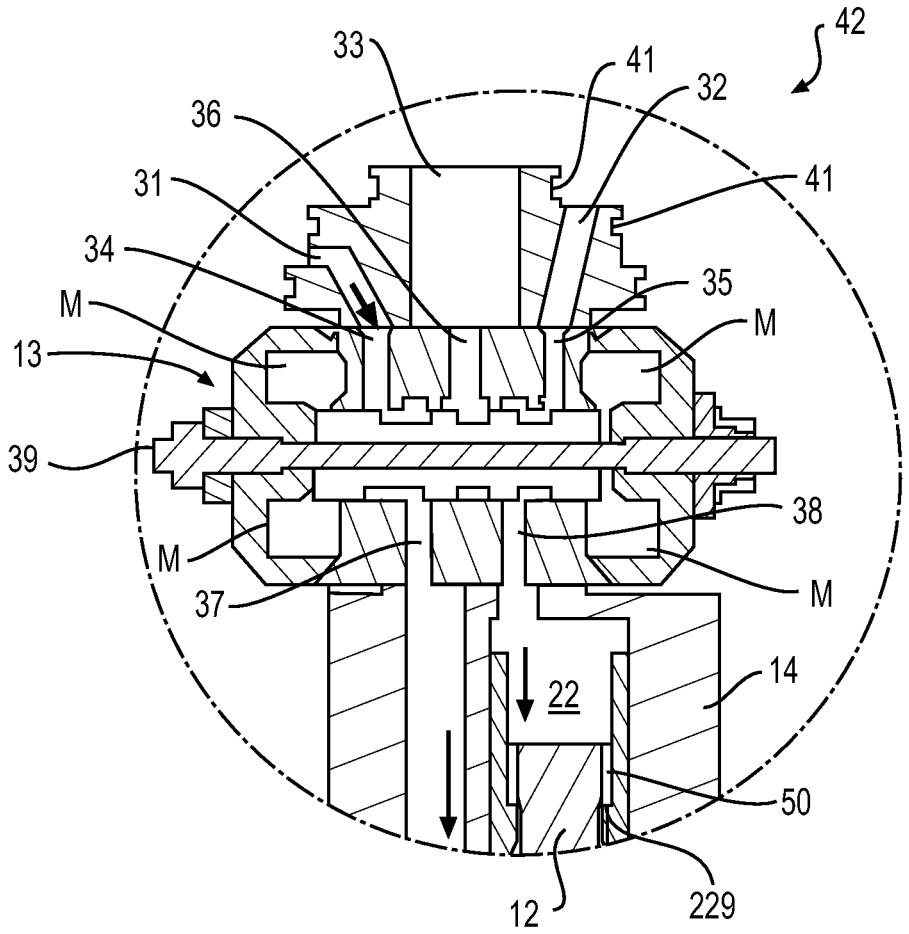
FIG. 4B is a view of the portion Y of FIG. 4B.

Fluid enters the upper recess 21 and presses against both first piston 11 and second piston 12. The fluid pressure is primarily used to move second piston 12 toward engine block 17 so that valve stem 16 opens valve 15 fully for exchange of combustion gases or exhaust in fluid exchange area 19. This condition is shown in FIGS. 4A and 4B. Second piston has a second travel distance in the range T2. The distance T2 is from a position where edge 228 no longer abuts edge 128, and up to a position where ring surface 51 abuts edge 129. Because of fluid pressure and the abutment at ring surface 51, fluid pressure to surface 26 can cause first piston to move with the second piston even if no fluid pressure above ambient pressure is supplied to first tubular port 23. An alternative is to supply pressure to first tubular port 23 to move the first piston 11, and supply pressure to second tubular port 24 to move the second piston. Fluid control via ECU 300 can allow for adjustments to fluid pressure and, consequently, travel distances. As explained later, the timing of travel can be controlled via ECU 300 control of spool 391.

Figure 3:
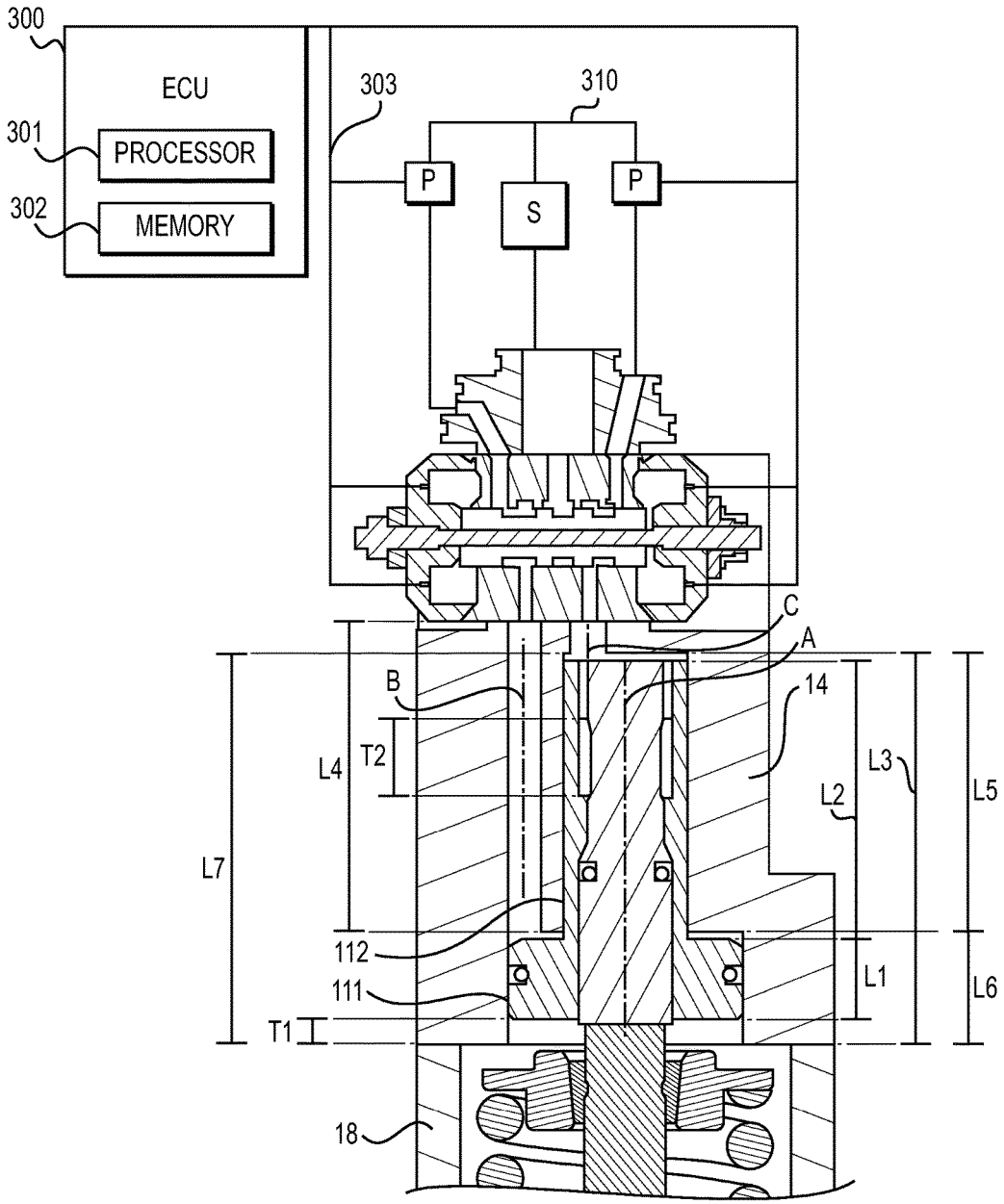
FIG. 3 is a view illustrating hydraulic fluid control and supply for positively actuating the actuator.

The actuator 10 can form part of an electro-hydraulically actuated engine valve, as illustrated in FIGS. 1B, and 4B. A schematic for actuation may be as illustrated in FIG. 3.

A hydraulic connector 42 comprises a first hydraulic fluid port 31, a second hydraulic fluid port 32, and a hydraulic fluid outlet 33. The first hydraulic fluid port 31 and the second hydraulic fluid port 32 are configured to connect to a source of hydraulic fluid, such as a controllable fluid pump P. The hydraulic fluid outlet 33 is configured to connect to a sump S. The hydraulic fluid may circulate from the sump S to the pumps P via supply lines 310, and the pumps P can be controlled via appropriate control electronics affiliated with control signal lines 303. Glands 41 house o-rings to provide fluid separation and sealing.

A spool valve assembly 13 comprises a first spool inlet 34, a second spool inlet 35, a spool outlet 36, a first spool port 37, a second spool port 38, an actuatable spool 391, grooves 390, actuation devices M, and connections to control devices and control signal lines 303. Appropriate electrical signals to actuation devices, such as the illustrated electromagnets M, cause the spool 391 to turn or slide on the spool pin 39 in the housing of the spool valve assembly 13. Spool can selectively abut one or more of the spool outlet, first and second spool ports, and first and second spool inlets of the spool valve assembly to block the passage of hydraulic fluid, or grooves 390 in the spool 391 can be positioned to permit hydraulic fluid passage within spool valve assembly 13. The location and size of the grooves 390 can be tailored for selective passage of hydraulic fluid, such that one, none, or both of the first and second spool ports communicate with the first and second spool inlets or spool outlet at any given time. That is, the spool grooves and spool actuation can be designed and controlled to achieve the operation methods for fluid flow such that the control devices control the actuation devices M to slide the grooves 390 in to and out of alignment with the first spool inlet 34, the second spool inlet 35, the spool outlet 36, the first spool port 37, and the second spool port 38.

With respect to the hydraulic connector 42, the first spool inlet 34 aligns with the first hydraulic fluid port 31, the second spool inlet 35 aligns with the second hydraulic fluid port 32, and the spool outlet 36 aligns with the hydraulic fluid outlet 33.

For directing fluid, the grooves 390 can be assigned to one or more sets. A particular groove 390 can be part of one or more sets such that as the spool slides, the groove is sized to permit fluid passage for a particular fluid passageway despite another groove changing its fluid-blocking or fluid-passing capability. When a first set of the grooves align with the first spool inlet 34 and the first spool port 37, the actuator is configured to connect the source of hydraulic fluid to the first tubular port 23. When a second set of the grooves align with the second spool inlet 35 and the second spool port 38, the actuator is configured to connect the source of hydraulic fluid to the second tubular port 24. When a third set of the grooves align with the first spool port 37, the second spool port 38, and the spool outlet 36, the actuator is configured to connect to the sump S. The grooves 390 can be tailored to allow fluid flow to both tubular ports 23, 24 simultaneously, but at different pressures.

The pumps P can direct the fluid flow by setting the supply line 310 pressure between the pumps P and the tubular ports 23, 24. Pumps P can then be controlled to direct the pressure and amount of hydraulic fluid to actuate or deactivate the first piston 11 and or second piston 12. In another embodiment, the hydraulic fluid outlet is affiliated with a pump for assisting with fluid return from the actuator 10 to the sump S.

Figure 2:
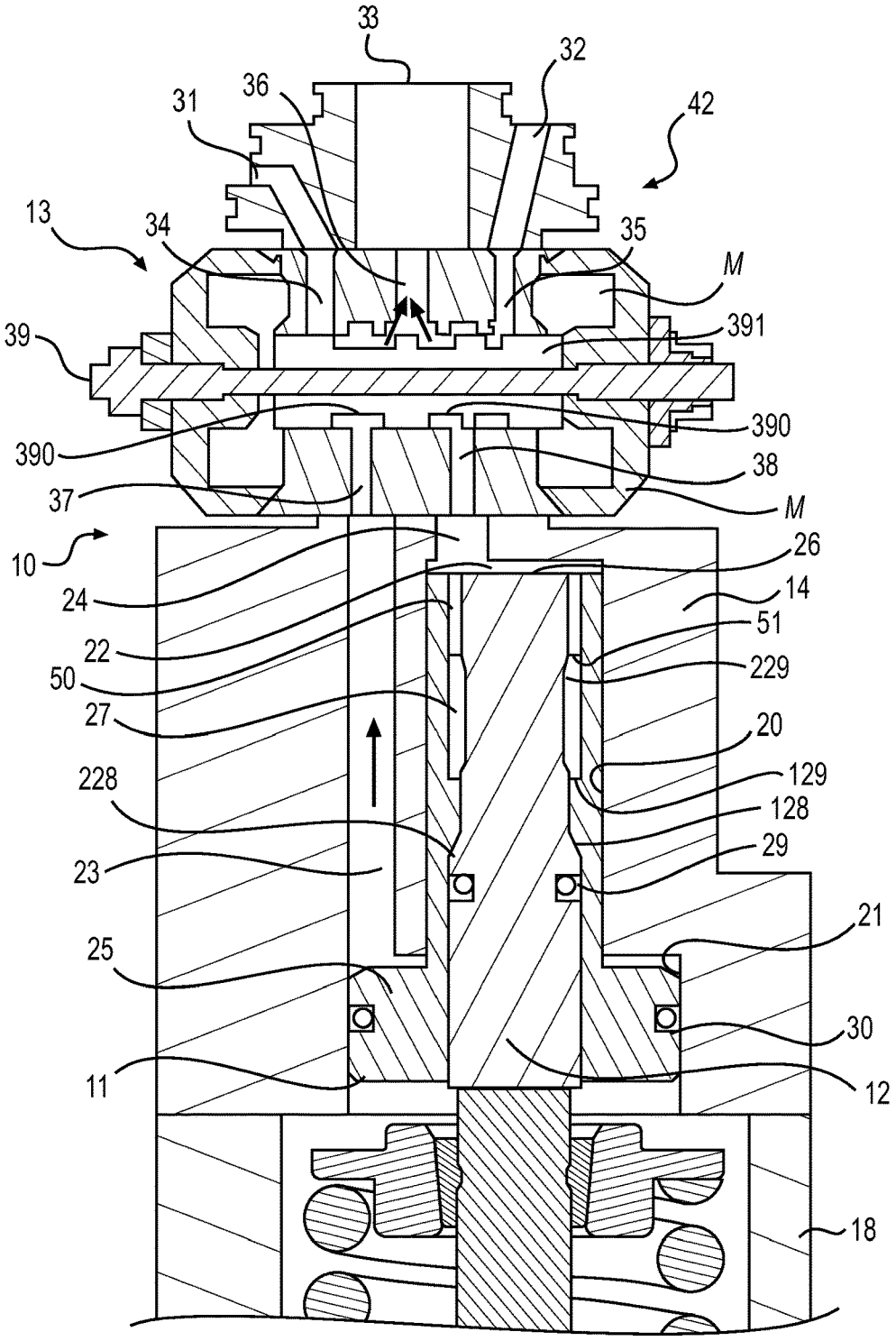
FIG. 2 is cross-section view of an actuator and spool valve assembly in an unactuated, fluid draining condition.

The unactuated condition is shown in FIG. 2, where the fluid is actively or passively drained out of the actuator, and the first and second pistons 11 and 12 are in an elevated position. The spring shown in the valve assembly 18 provides sufficient force to push the first and second pistons 11, 12 to the unactuated condition; and, the spring can cause the valve 15 to seat against the engine block 17.

A valve stem assembly 18 abuts the actuator housing 14. A valve stem 16 is slidably housed in the valve stem assembly 18. Customary valve stem assembly features, such as braces, caps, springs, guides etc. align the valve stem and cooperate with the actuator 10 to move the valve 15 up and down. The valve stem 16 abuts the second piston 12 so that a surface of the second piston 12 can push against the valve stem 16. Valve stem comprises a valve head 15 configured to adjust an opening or closing of a fluid exchange area 19 of an engine block 17.

A method of operating an electro-hydraulic actuator can be executed by an onboard computing chip, such as electronic control unit (ECU) 300. ECU 300 communicates with other vehicle parts, such as sensors affiliated the engine, manifolds, fuel injectors, brakes, accelerator, etc. to determine when hydraulic fluid should be supplied to first and or second tubular ports 23, 24. Thus a memory device, such as a RAM, ROM, EPROM, etc. stores computer executable programming, predetermined values, updated system data such as sensor inputs, etc. to determine timing, pressure, and amount of hydraulic fluid necessary to move first and or second piston 11, 12. A processor 301 assists with data processing and executes the stored programming.

For example, when it is advantageous to provide engine braking, a method comprises supplying fluid at a first pressure to the first tubular port and supplying fluid at a second pressure to the second tubular port. Because of the diameter differences between the first extant 111, second extant 112, first cylindrical portion 122, and second cylindrical portion 121, the minimum pressure necessary to move each of the first and second piston 11, 12 can be selected to provide only engine braking, or alternatively full valve lift.

Since the first piston 11 provides a small range of motion with a slower valve seating rate, it is advantageous to move only first piston 11 to provide engine braking. Thus, the second pressure is less than the first pressure. And, the first pressure to the first tubular port moves the first piston a distance in a first travel range T1. As a working example only, and not to limit the lengths, diameters, or ranges available, the first pressure is about 1500 psi (pounds per square inch) and moves the first piston first travel T1=1 mm. The second pressure is set equal to ambient pressure, though it can alternatively receive the same pressure of 1500 psi.

Another method comprises the second pressure set equal to the first pressure at 2000 psi. The first piston moves a distance in a first travel range T1=1 mm, and the second piston moves a distance in a second range T2=9 mm. Thus, full valve lift is achieved, and the engine has all available capacity for fluid exchange at fluid exchange area 19. Other travel ranges T1, T2 can be selected based on required performance.

Another method sets the second pressure higher than the first pressure, but the second pressure is high enough to move second piston 12 and, via abutment of ring surface 51 with second edge 129, to move first piston 11.

Other implementations will be apparent to those skilled in the art from consideration of the specification and practice of the examples disclosed herein. For example, while the actuator is shown mounted directly to an engine valve, it is possible in an alternative to use the actuator with a bridge. The actuator can be used with a rocker arm to open two valves, or the actuator can be used on top of a rocker arm. It is intended that the specification and examples be considered as exemplary only, with a true scope and spirit of the invention being indicated by the following claims.

What is claimed is:

1. An actuator, comprising:

a hollow first piston comprising a first extant and a second extant;

a second piston slidable within the first piston; and an actuator housing comprising:

a recess comprising an upper recess with a length L5 and a lower recess with a length L6;

a first tubular port in fluid communication with the first piston; and a second tubular port in fluid communication with the second piston, wherein the first extant has a diameter D1, wherein the second extant has a diameter D2 that is less than the diameter D1, wherein the first piston and the second piston are housed in the recess, wherein the first extant is slidable in the lower recess, wherein the second piston is slidable in the lower recess, and wherein the second extant is slidable in the upper recess.

2. The actuator of claim 1, wherein the second piston is concentric with the first piston along an axis A-A, wherein the first tubular port comprises a first central axis B-B, wherein the second tubular port comprises a second central axis C-C, and wherein axis A-A is parallel to first central axis B-B and second central axis C-C.

3. The actuator of claim 2, wherein the first piston and the second piston reciprocate along the axis A-A.

4. The actuator of claim 1, wherein the first tubular port fluidly communicates with only the first piston, and wherein the second tubular port fluidly communicates with both the first piston and the second piston.

5. The actuator of claim 1, wherein the first tubular port has a length L4, wherein the second extant has a length L2, and wherein length L4 is greater than length L2.

6. The actuator of claim 1, wherein the inner surface of the first piston further comprises a notch for providing a fluid passageway between the first piston and the second piston.

7. The actuator of claim 6, wherein the second piston further comprises at least one diameter change to provide a fluid recess between the second piston and the first piston.

8. The actuator of claim 1, further comprising:

a hydraulic connector comprising a first hydraulic fluid port, a second hydraulic fluid port, and a hydraulic fluid outlet, wherein the first hydraulic fluid port and the second hydraulic fluid port are configured to connect to a source of hydraulic fluid, and the hydraulic fluid outlet is configured to connect to a sump, a spool valve assembly, comprising a first spool inlet, a second spool inlet, a spool outlet, a first spool port, a second spool port, an actuatable spool, actuation devices, and control devices, wherein the first spool inlet aligns with the first hydraulic fluid port, the second spool inlet aligns with the second hydraulic fluid port, and the spool outlet aligns with the hydraulic fluid outlet, wherein the spool further comprises grooves, wherein the control devices control the actuation devices to slide the grooves in to and out of alignment with the first spool inlet, the second spool inlet, the spool outlet, the first spool port, and the second spool port.

9. The actuator of claim 8, wherein, when a first set of the grooves align with the first spool inlet and the first spool port, the actuator is configured to connect the source of hydraulic fluid to the first tubular port, and, when a second set of the grooves align with the second spool inlet and the second spool port, the actuator is configured to connect the source of hydraulic fluid to the second tubular port.

10. The actuator of claim 9, wherein, when a third set of the grooves align with the first spool port, the second spool port, and the spool outlet, the actuator is configured to connect to the sump.

11. The actuator of claim 1, wherein the second piston comprises a first cylindrical portion with a diameter D4 and a second cylindrical portion with a diameter D3, wherein the first cylindrical portion abuts an interior surface of the first piston, and wherein a fluid recess is between the interior surface of the first piston and the second cylindrical portion.

12. The actuator of claim 1, wherein the first piston further comprises an inner surface comprising first edge and a second edge, wherein second piston further comprises third edge, and wherein, when the first piston moves a distance in a first travel range T1 away from first tubular port, the second piston moves the distance in a first travel range T1 via mating first edge with third edge.

13. The actuator of claim 1, wherein the first tubular port comprises a length L4 that is longer than the length of the second tubular port.

14. The actuator of claim 1, wherein the first tubular port extends alongside the second extant.

15. An electro-hydraulically actuated engine valve, comprising:

a hydraulic connector comprising a first hydraulic fluid port, a second hydraulic fluid port, and a hydraulic fluid outlet;

a spool valve assembly, comprising a first spool inlet, a second spool inlet, a spool outlet, a first spool port, a second spool port, an actuatable spool, and actuation devices;

an actuator, comprising:

a hollow first piston comprising a first extant with a first outer diameter D1 and a second extant comprising a second outer diameter D2, where D1>D2;

a second piston slidable within the first piston; and an actuator housing comprising a recess, a first tubular port in communication with the first piston, and a second tubular port in communication with the second piston;

a valve stem assembly abutting the actuator housing; and a valve stem slidably housed in the valve stem assembly, the valve stem abutting the second piston, the valve stem comprising a valve head configured to adjust an opening or closing of a fluid exchange area of an engine block, wherein the first hydraulic fluid port and the second hydraulic fluid port are configured to connect to a source of hydraulic fluid, wherein the hydraulic fluid outlet is configured to connect to a sump, wherein the first spool inlet aligns with the first hydraulic fluid port, the second spool inlet aligns with the second hydraulic fluid port, and the spool outlet aligns with the hydraulic fluid outlet, wherein the spool further comprises grooves, wherein the spool is slidable in the spool valve assembly to slide the grooves in to and out of alignment with the first spool inlet, the second spool inlet, the spool outlet, the first spool port, and the second spool port, wherein the first extant has a length L1 and wherein the second extant has a length L2, and wherein the first tubular port extends for a length L4, where L4 L2, wherein the recess extends for a length L3, where L3>(L2+L1), and wherein the first piston and the second piston are housed in the recess.

16. The engine valve of claim 15, wherein the recess comprises an upper recess with a length L5 and a lower recess with a length L6, wherein the first extant is slidable in the lower recess, and wherein the second piston is slidable in the lower recess, wherein the second extant is slidable in the upper recess.

17. The engine valve of claim 16, wherein the lower recess is configured to provide the first piston a travel distance in a first travel range T1, and wherein the recess and the valve assembly are configured to provide the second piston a travel distance in a second travel range T2.

18. The engine valve of claim 15, wherein the first piston further comprises an inner surface comprising a first edge and a second edge, wherein the second piston further comprises a third edge and a ring, wherein the second piston is slidable within the first piston to move between a first position mating the first edge and the third edge and a second position mating the second edge and a ring surface of the ring.

19. A method of operating an electro-hydraulic actuator, the actuator comprising:

a hollow first piston comprising a first extant and a second extant;

a second piston slidable within the first piston; and an actuator housing comprising a recess, a first tubular port in fluid communication with the first piston, and a second tubular port in fluid communication with the second piston, wherein the first extant has a length L1 and wherein the second extant has a length L2, wherein the first extant has a diameter D1, wherein the second extant has a diameter D2 and D2<D1, wherein the first tubular port extends for a length L4, where L4 L2, wherein the recess extends for a length L3, where L3>L2>L1, and wherein the first piston and the second piston are housed in the recess, the method comprising:

supplying fluid at a first pressure to the first tubular port; and supplying fluid at a second pressure to the second tubular port, wherein, when the first tubular port and the second tubular port receive a predetermined fluid pressure, the first piston travels slower than the second piston.

20. The method of claim 19, wherein the second pressure is equal to the first pressure, wherein the step of supplying fluid at a first pressure to the first tubular port moves the first piston a distance in a first travel range T1, and wherein the step of supplying fluid at a second pressure to the second tubular port moves the second piston a distance in a second travel range T2.

21. The method of claim 20, wherein the first piston further comprises an inner surface comprising a first edge and a second edge, wherein the second piston further comprises a third edge and a ring, and wherein the second piston is slidable within the first piston to move between a first position mating the first edge and the third edge and a second position mating the second edge and the ring.

22. The method of claim 21, wherein the second pressure is less than the first pressure, wherein the step of supplying fluid at a first pressure to the first tubular port moves the first piston a distance in a first travel range T1, and wherein, when the first piston moves the distance in the first travel range T1, the second piston moves the distance in the first travel range T1 via mating the first edge with the third edge.

23. The method of claim 19, wherein the actuator further comprises a spool valve assembly comprising a first spool inlet, a second spool inlet, a spool outlet, a first spool port, a second spool port, an actuatable actuation devices, and control devices, wherein the spool further comprises grooves, wherein the method further comprises controlling the actuation devices to slide the grooves in to and out of alignment with the first spool inlet, the second spool inlet, the spool outlet, the first spool port, and the second spool port, wherein, when a first set of the grooves align with the first spool inlet and the first spool port, the actuator is configured to connect a source of hydraulic fluid to the first tubular port, wherein, when a second set of the grooves align with the second spool inlet and the second spool port, the actuator is configured to connect the source of hydraulic fluid to the second tubular port, and wherein, when a third set of the grooves align with the first spool port, the second spool port, and the spool outlet, the actuator is configured to connect to a sump.

24. An actuator, comprising:

a hollow first piston comprising:

a first extant and a second extant; and an inner surface with a first edge and a second edge;

a second piston slidable within the first piston, the second piston comprising:

a third edge; and a ring; and an actuator housing comprising:

a recess;

a first tubular port in fluid communication with the first piston; and a second tubular port in fluid communication with the second piston, wherein the first piston and the second piston are housed in the recess, wherein the first tubular port extends alongside the second extant, and wherein the second piston is configured to travel between a first position where the third edge abuts the first edge and a second position where a ring surface of the ring abuts the second edge.

25. The actuator of claim 24, wherein the inner surface of the first piston further comprises a notch for providing a fluid passageway between the first piston and the second piston.

26. The actuator of claim 25, wherein the second piston further comprises at least one diameter change to provide a fluid recess between the second piston and the first piston.

27. The actuator of claim 24, wherein the first tubular port fluidly communicates with only the first piston, and wherein the second tubular port fluidly communicates with both the first piston and the second piston.

* * * * *